US009320934B1

(12) United States Patent
Pringle

(10) Patent No.: US 9,320,934 B1
(45) Date of Patent: Apr. 26, 2016

(54) EXERCISE DEVICE FOR USE BY DRIVERS

(71) Applicant: Daniel N. Pringle, Wake Forest, NC (US)

(72) Inventor: Daniel N. Pringle, Wake Forest, NC (US)

( * ) Notice: Subject to any disclaimer, the term of this patent is extended or adjusted under 35 U.S.C. 154(b) by 26 days.

(21) Appl. No.: 14/341,188

(22) Filed: Jul. 25, 2014

(51) Int. Cl.
*A63B 21/00* (2006.01)

(52) U.S. Cl.
CPC ..... *A63B 21/00047* (2013.01)

(58) Field of Classification Search
CPC ..... A63B 1/00; A63B 3/00; A63B 21/00047; A63B 21/00185; A63B 21/068; A63B 21/16; A63B 21/169; A63B 21/4029; A63B 23/1218–23/1227
See application file for complete search history.

(56) References Cited

U.S. PATENT DOCUMENTS

| | | | | |
|---|---|---|---|---|
| 5,133,429 | A | 7/1992 | Densley | |
| 5,558,608 | A * | 9/1996 | Hall | A63B 21/0552 482/129 |
| 7,059,449 | B2 | 6/2006 | Zhang | |
| 7,455,307 | B2 | 11/2008 | Seely et al. | |
| 8,485,951 | B1 | 7/2013 | Adams | |
| 8,535,204 | B2 | 9/2013 | Stacey | |
| 2006/0186638 | A1 * | 8/2006 | Varner | A63B 71/023 280/506 |
| 2012/0279802 | A1 | 11/2012 | Filkowski | |
| 2013/0035220 | A1 | 2/2013 | Adams | |
| 2013/0053220 | A1 | 2/2013 | Monaco | |

FOREIGN PATENT DOCUMENTS

| | | |
|---|---|---|
| DE | 102011116792 A1 | 4/2013 |
| KR | 200371871 | 12/2004 |

* cited by examiner

*Primary Examiner* — Loan H Thanh
*Assistant Examiner* — Jennifer M Deichl
(74) *Attorney, Agent, or Firm* — Coats & Bennett, P.L.L.C.

(57) ABSTRACT

The present application is directed to an exercise device that is applicable for use by a driver while out on the road. The device includes a frame with one or more horizontal supports configured to provide for one or more different exercises. A tire connector may extend outward from the frame and is configured to connect to the tire of the vehicle. The tire connector supports the frame outward from the tire and the side of the vehicle. The frame provides a sturdy platform for the driver to perform a variety of different exercises. The device is constructed from multiple pieces that can be assembled and disassembled in a straight-forward manner for use while the driver is out on the road. Each of the pieces is sized to be stored on the vehicle when disassembled and not in use.

18 Claims, 10 Drawing Sheets

EXERCISE DEVICE FOR USE BY DRIVERS

BACKGROUND

The present application is directed to an exercise device configured to be removably connected to a vehicle for use in performing a variety of exercises and, more particularly, to an exercise device that is disassembled/assembled in a straight-forward manner to facilitate use by drivers when out on the road.

Drivers of large vehicles, such as truck drivers, often do not have the opportunity to exercise. This is because their schedule requires them to spend a majority of their time on the road. This includes the actual time they are driving their vehicle, as well as off time which is often spent either in a hotel room or sleeping in their truck cab.

Existing exercise equipment is not applicable for use by truck drivers while they are on the road. Some equipment is too large and cannot be stored on the truck. Examples include the large equipment that is used in hotel and home gyms that provide for multiple exercises and include one or more weight stacks connected to pulleys. Further this equipment, and other equipment such as free weights and dumbbells, is too heavy to be taken on the road by the driver.

Some equipment would damage the truck cab or truck trailer if used by a driver. Damage may be caused by the equipment contacting against the exterior of one or both of the cab and trailer during exercising. This contact may scratch, dent, or otherwise cause damage. Further, some existing equipment requires a permanent connection with the cab and/or trailer. This may include mechanical fasteners or other means to fixedly attach the exercise equipment to the truck. The connection points results in damage to the truck, such as requiring holes or other mechanisms for secure attachment. Further, truck drivers often use different cabs and/or trailers. This type of equipment with the fixed connection to the vehicle is not portable and not applicable for use by a driver that uses a variety of different cabs/trailers.

SUMMARY

The present application is directed to an exercise device that is applicable for use by a driver while out on the road. The device includes a frame with one or more horizontal supports configured to provide for one or more different exercises. A tire connector may extend outward from the frame and is configured to connect to the tire of the vehicle. The tire connector may support the frame outward from the tire and the side of the vehicle. The frame provides a sturdy platform for the driver to perform a variety of different exercises. The device is constructed from multiple pieces that can be assembled and disassembled in a straight-forward manner for use while the driver is out on the road. Each of the pieces is sized to be stored on the vehicle when disassembled and not in use.

One embodiment is directed to a method of using an exercise device with a vehicle with the vehicle including a tire and a sidewall positioned vertically above the tire. The method includes attaching a vertical support to a base with the vertical support extending vertically outward from the base. The method includes attaching a horizontal support to the vertical support with the horizontal support extending outward from a front of the vertical support. The method includes attaching a tire connector to the vertical support with the tire connector extending outward from a rear of the vertical support and including a pair of spaced-apart supports that extend outward from the rear of the vertical support and first and second cross-braces that extend across a gap between the spaced-apart supports and the first and second cross-braces being spaced horizontally away from the vertical support. The method includes positioning the base on the ground and the tire connector on the tire of the vehicle with the spaced-apart supports positioned on tire treads on opposing front and rear sides of the tire and the first cross-brace positioned along an inner side of the tire away from the vertical support and the second cross-brace positioned along an outer side of the tire towards the vertical support. The method includes positioning the vertical support horizontally away from the tire and the sidewall of the vehicle with the base contacting against the ground and the tire connector contacting against the tire and the horizontal support positioned vertically above the tire. The method also includes maintaining the vertical support spaced horizontally away from the tire and the sidewall of the vehicle while exercising with the horizontal support.

The method may also include attaching the horizontal support to the vertical support prior to attaching the base to the vertical support.

The method may also include positioning the tire connector along the vertical support between the horizontal support and the base.

The vertical support may include first and second elongated members that are spaced apart from one another, and attaching the vertical support to the base may include attaching the first elongated member to a first receptacle in the base and attaching the second elongated member to a second receptacle in the base.

The method may include positioning the base relative to the vertical support with the base extending outward from the front and the rear of the vertical support.

The method may include positioning the horizontal support a greater distance outward from the vertical support than the base.

The method may include inserting an extension on the brace within a receptacle in the vertical support with the extension and the receptacle in an overlapping orientation.

Another embodiment is directed to a method of using an exercise device with a vehicle with the vehicle including a tire and a sidewall positioned vertically above the tire. The method includes assembling together a frame that includes a base with legs that contact against the ground, a vertical support, and at least two horizontal supports that each extend outward from a front of the vertical support and are spaced away from the base with each of the base, the vertical support and the horizontal supports being separate prior to the assembly. The method includes positioning the frame at the vehicle with the vertical support extending in front of the sidewall of the vehicle. The method also includes attaching the frame to the vehicle, and positioning the vertical support horizontally away from the sidewall of the vehicle with the base contacting against the ground while exercising with each of the horizontal supports.

Attaching the frame to the vehicle may include attaching one or more clamps to the vehicle.

Attaching the frame to the vehicle may include attaching a tire connector that extends from a rear of the vertical support to the tire by positioning the connector against the front and rear treads of the tire and contacting a rear brace of the tire connector in contact with a back side of the tire that is away from the vertical support.

The method may also include contacting a front brace of the tire connector in contact with a front side of the tire that is facing towards the vertical support, the front brace being spaced away from the rear brace by a gap that is sized to position the tire.

Each of the front and rear braces may be straight.

The method may also include positioning the tire connector against the tire and contacting the tire at three separation locations.

The method may also include positioning each of the horizontal supports to extend perpendicularly outward from the sidewall of the vehicle.

The method may also include contacting the base against the ground the tire connector against the tire and preventing the vertical support from pivoting away from the sidewall of the vehicle while exercising.

A first one of the horizontal supports may extend outward from a vertical top of the vertical support.

Another embodiment is directed to a method of using an exercise device with a vehicle with the vehicle including a tire and a sidewall positioned vertically above the tire. The method includes assembling together a frame that includes a base with legs that contact against the ground, a vertical support, and a horizontal support. The method includes moving the horizontal support from a closed orientation to an open orientation by pivoting the horizontal support about an axis that extends through the vertical support and moving an outer end of the horizontal support to an extended position away from the horizontal support. The method includes positioning the frame at the vehicle with the base at the tire of the vehicle with the vertical support extending in front of the tire and the sidewall of the vehicle and the horizontal support positioned above the tire. The method includes attaching a tire connector that extends from a rear of the vertical support to the tire of the vehicle. The method includes positioning the vertical support horizontally away from the tire and the sidewall of the vehicle with the base contacting against the ground and the tire connector contacting against the tire. The method also includes maintaining the vertical support spaced horizontally away from the tire and the sidewall of the vehicle while exercising with each of the horizontal supports.

The method may also include positioning the tire in a gap formed by the tire connector with the tire connector extending completely around the tire.

The method may also include attaching the tire connector to the tire prior to moving the horizontal support from the closed orientation to the open orientation.

The various aspects of the various embodiments may be used alone or in any combination, as is desired.

DETAILED DESCRIPTION

The present application is directed to an exercise device configured to be used by drivers of large vehicles, such as truck drivers. The device is configured to be attached along the side of a truck for use by the driver when out on the road. The device is straight-forward to assemble and disassemble, and is sized to be stored on the truck when not in use.

Figure 1A:
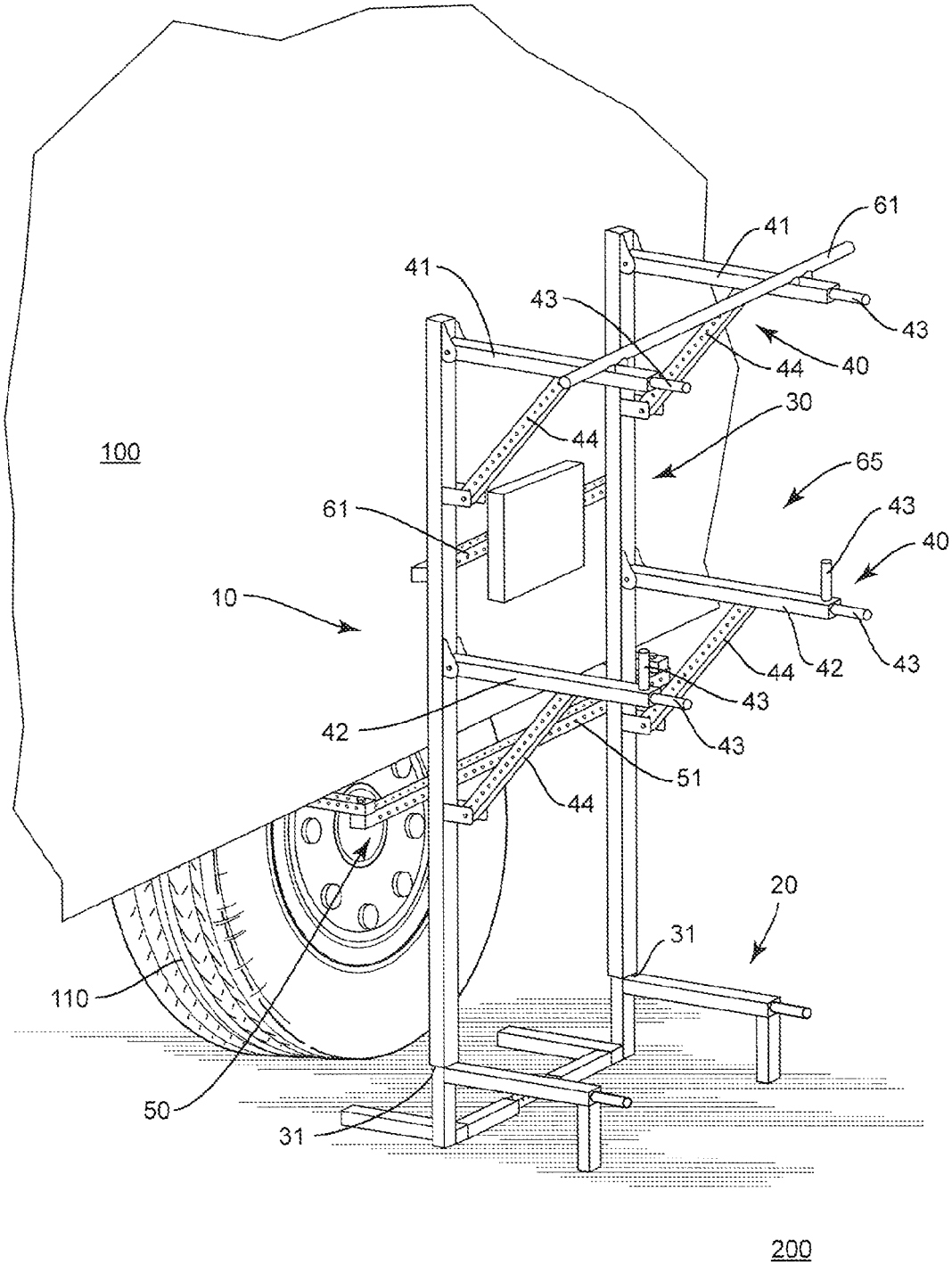
FIG. 1A is a perspective view of an exercise device positioned at a truck trailer.
Figure 1B:
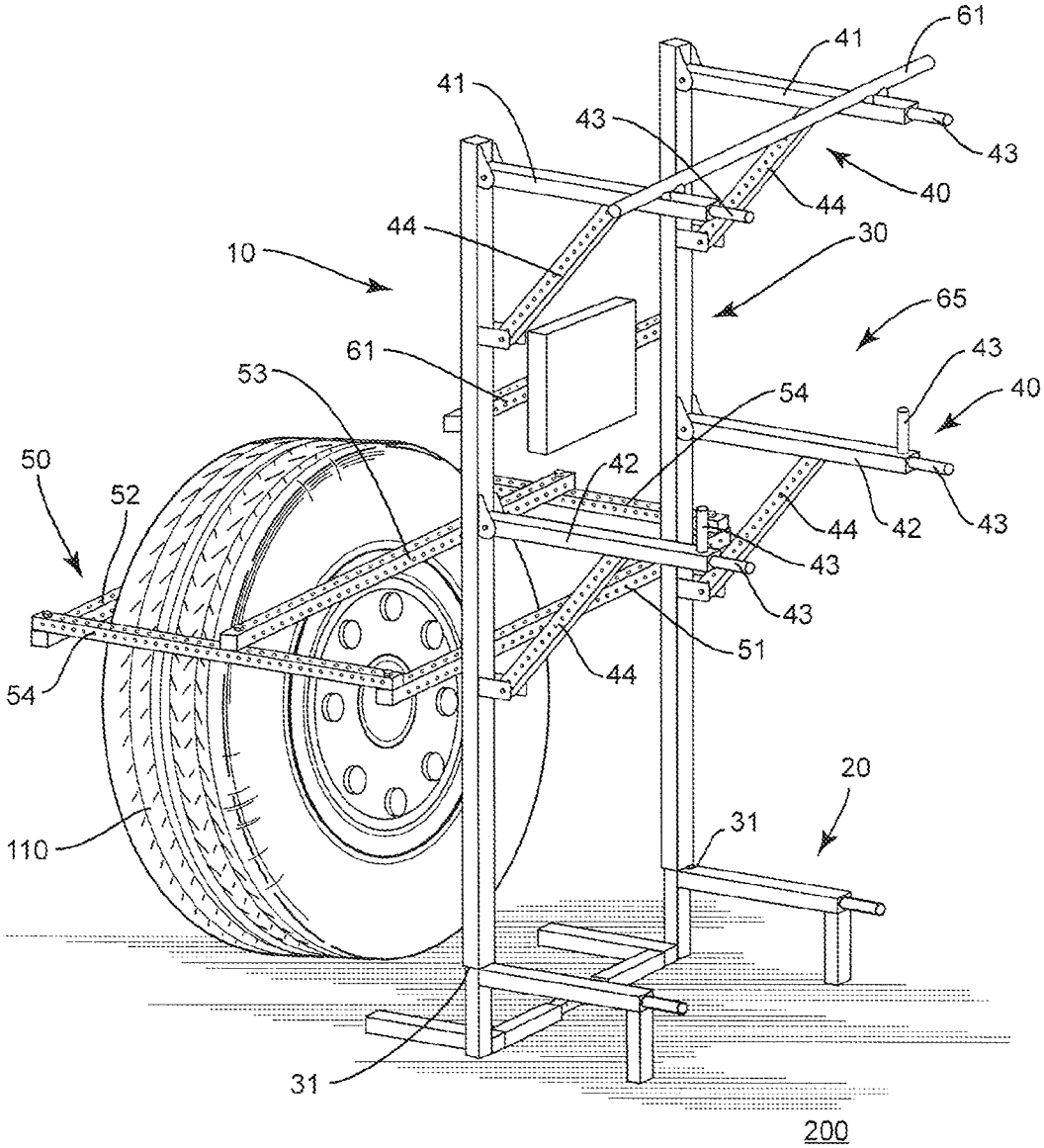
FIG. 1B illustrates the device of FIG. 1A with a tire connector connected to a tire of the truck trailer.

FIG. 1A illustrates the device 10 mounted along the side of a truck trailer 100. The device 10 includes a frame 65 with a base 20 that is positioned on the ground, a vertical support 30 that extends upward from the base 20, and one or more horizontal supports 40 that extend outward in a forward direction from the vertical support 30 and are configured for the user to perform one or more exercises. The device 10 also includes a connector 50 that extends horizontally outward in a rearward direction from the vertical support 30 to extend around a tire 110 of the truck. FIG. 1B illustrates the device 10 with the side of the trailer 100 removed for purposes of clarity to illustrate the connector 50 mounted to the tire 110. The connector 50 is positioned along a top side of the tire 110 to support the device 10 and provide for positioning along the side of the trailer 100.

The device 10 is configured to be used by the driver while out on the road. The device 10 is constructed from multiple different pieces sized to be stored on the truck when not in use. When preparing to use the device 10, the driver positions the truck in a conducive location, such as in a parking lot, rest area, or other like location in which the side of the trailer 100 is exposed to provide space for assembly of the device 10, mounting to the trailer 100, and exercise. The assembly includes the driver placing the various pieces together in a straight-forward manner. The device 10 is aligned with the truck with the base 20 in contact with the ground and the connector 50 placed around the tire 110. The driver is then able to perform the various exercises using the device 10. The tire connector 50 supports the frame 65 and positions the frame 65 outward from the side of the truck to prevent damage that could occur if the frame 65 was in contact. Once completed, the device 10 is disassembled into the relative small separate pieces that are stored on the truck.

Figure 2:
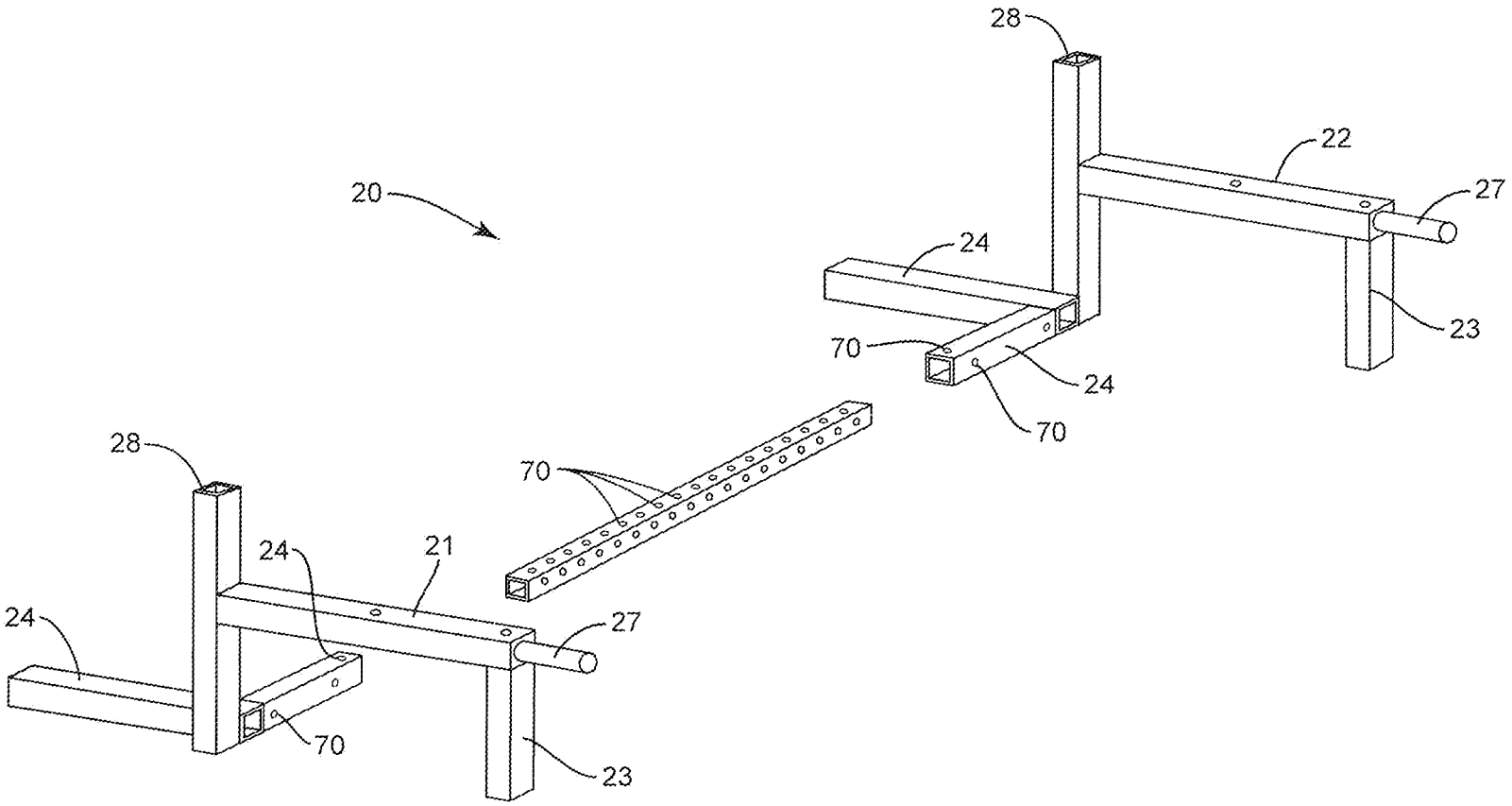
FIG. 2 is an exploded perspective view of a brace of an exercise device.

The base 20 is configured to contact against the ground to support the device 10 when the device 10 is mounted to the trailer 100. FIG. 2 illustrates an exploded view of a base 20 that includes a pair of feet 21, 22 each configured to contact against the ground and provide support for the device 10. Each foot 21, 22 is configured to contact the ground at multiple different positions through a vertical support 23, leg 24, and receptacle 25. A bar 26 is configured to attach to each of the receptacles 25 at a variety of different positions to connect the feet 21, 22 together. In one embodiment, each receptacle 25 includes one or more apertures and the bar 26 includes apertures along its length. The apertures in the bar 26 are aligned with the apertures in the receptacles 25 to receive a fastener. Fasteners may include a variety of different bolts, pins, rivets, etc. that have a length to extend through the elements. Fasteners may also include a fixture such as a bolt or pin that prevents the fastener from inadvertently being removed from the receptacle 25 and bar 26. Each foot 21, 22 also includes a handle 27 that is positioned above the ground for the user to perform push-up exercises.

The base 20 may be constructed from multiple separate pieces as illustrated in FIG. 2. When not in use, the base 20 may be disassembled into two or more pieces to facilitate storing on the truck. The base 20 may also be a single piece as the overall size may be sufficiently small to allow for storage on the truck when the device 10 is not in use.

The vertical support 30 is configured to connect to the base 20. The vertical support 30 may include two or more separate members as illustrates in FIGS. 1A and 1B that include a pair of vertical supports. Vertical support 30 may also include a single member. In multiple member configurations, the different members may include the same or different shape and/or size.

In a two-member embodiment as illustrated in FIGS. 1A and 1B, each support 30 includes an elongated, straight shape. The supports 30 may be hollow and include open lower ends 31 sized to receive the receptacles 28 on the base 28. When assembled, the lower ends 31 and the receptacles 28 are aligned in an overlapping arrangement. In one embodiment as illustrated in FIGS. 1A and 1B, the lower ends 31 extend around the receptacles 28. In another embodiment, the lower ends 31 of the vertical support 30 are positioned within the receptacles 28 of the base 20. The vertical supports 30 and receptacles 28 may each include rectangular cross-sectional shapes that prevent the elements from rotating relative to each other while the driver is exercising.

The height of the vertical support 30 may vary, provided it extends at least above the tire 100 when connected with the base 20. In one embodiment, the height provides for the driver to stand fully upright while performing pull-up exercises using an upper horizontal extension 40. The height may also be less to facilitate storage in the truck.

In embodiments with multiple vertical supports 30, one or more cross-braces extend between and connect the vertical supports 30. The cross-braces support the vertical supports 30 and prevent their relative movement while the device 10 is in use. As illustrated in FIGS. 1A and 1B, one cross-brace includes member 51 that forms a portion of the tire connector 50. A second cross-brace 61 may form a portion of a backrest positioned at a lower horizontal extension 40. Various other cross-brace members may be positioned at various heights along the vertical supports 30. These cross-brace members may connect directly to the vertical supports 30. Additional cross-brace members may connect to the horizontal extensions 40 and provide support to the vertical supports 30. One example is a pull-up bar 61 that extends between upper horizontal extensions 41.

One or more horizontal supports 40 extend outward from a front of the vertical support 30 and are configured for the driver to perform various exercises. The horizontal supports 40 may include a single member, or may include multiple members.

An upper horizontal support 41 is formed by a pair of members that each extend outward from an upper section of the vertical support 30. In one embodiment, the upper horizontal support 41 is connected at the top end of the vertical support 30. In one embodiment, each member extends perpendicularly outward from the vertical supports 30 to which they are attached. A bar 61 extends across and is attached to an outer portion of each member. The bar 61 supports the member, and also forms a pull-up bar for the driver to perform a variety of exercises. Handles 43 may extend outward from the members to provide another grip for the driver to perform exercises.

An intermediate support 42 may be positioned between the base 20 and the upper support 41. As with the upper support 41, the intermediate support 42 may be formed by one or more members. In one embodiment, the intermediate support 42 includes a pair of members that are connected to and extend perpendicularly outward from the vertical supports 30. Handles 43 may extend outward from one or both of the distal ends and upper sides of the supports 42 to provide a grip for the user while performing various exercises.

Figure 3:
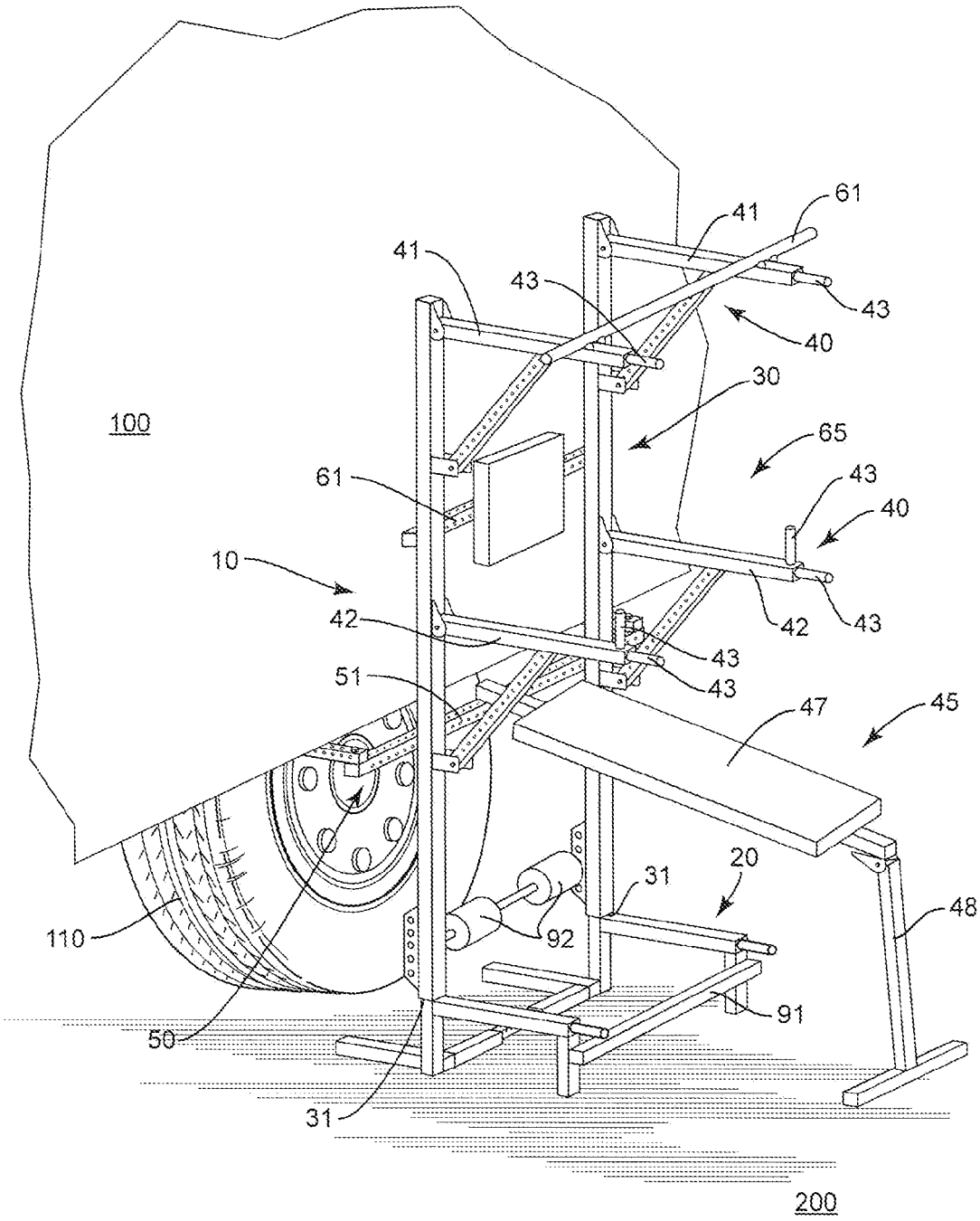
FIG. 3 is a side perspective view of an exercise device that includes a bench.

A lower horizontal support 45 may be positioned between the intermediate support 42 and the base 20 as illustrated in FIG. 3. The lower support 45 may include a single member, or multiple members. In the embodiment of FIG. 3, the lower support 45 forms a bench 45 is positioned along the vertical supports 30 between the intermediate supports 42 and the base 20. The lower support 45 is a single member that is connected to the cross-brace 51 of the tire connector 50. In another embodiment, the lower support 45 includes a pair of members that are connected to the pair of vertical supports 30. A platform 47 is positioned on the top side of the support 45 to provide a surface against which the driver can sit and/or lay down. The platform 47 may also be pivotally attached relative to the vertical supports 30. The platform 47 may be pivoted to a position between the vertical supports 30 to be away from the user when they are using the upper horizontal supports 40 and as a back rest for use when performing knee raises. A leg 48 extends from the lower support 45 to the ground to support the bench at the desired horizontal orientation.

The device 10 may also include various other elements to perform additional exercises. As illustrated in FIG. 3, examples of such elements include a bar 91 that extends between the brace 20 to perform calf raise exercises, and rollers 92 positioned between the vertical supports for bracing one's feet when performing sit-up exercises.

Angled braces 44 may be positioned on the underside of the horizontal extensions 40. The braces 44 are positioned between the vertical support 30 and the particular horizontal extension 40 to provide strength and support. For each brace 44, a first end is connected to the vertical support 30 and an opposing second end is connected to an underside of the horizontal extension 40.

The various frames may include one or more horizontal extensions 40 spaced at various locations along the vertical length of the vertical support 30. The horizontal extensions 40 extend outward from a front side of the vertical support 30 and are configured to offer different exercises to the driver.

The tire connector 50 is connected to and extends horizontally outward from the rear of the vertical supports 30. The tire connector 50 supports the frame 65 to prevent tipping during use. The tire connector 50 also positions the frame 65 outward from the truck to prevent contact that could damage the truck (e.g., scratches, dents).

Figure 4:
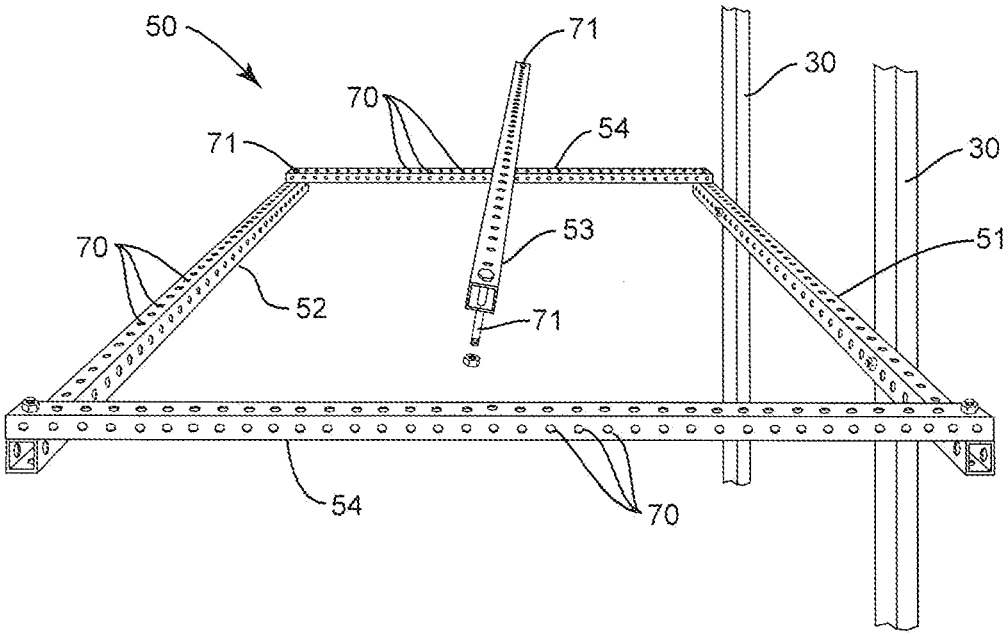
FIG. 4 is a perspective view of a tire connector with an intermediate cross-brace removed.
Figure 5:
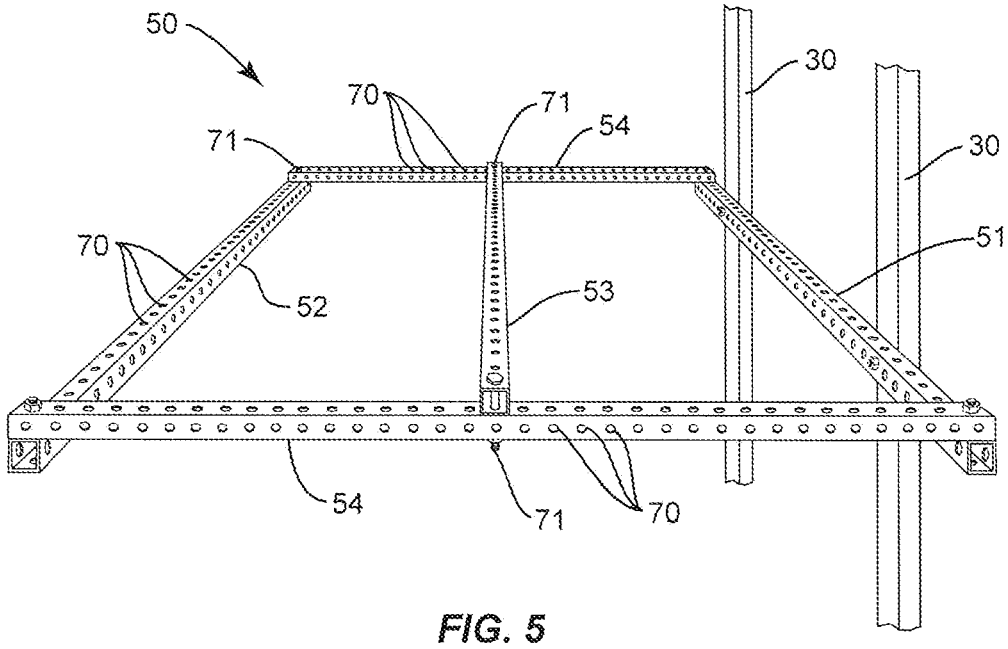
FIG. 5 is a perspective view of the tire connector of FIG. 4 with the intermediate cross-brace connected to horizontal supports.

FIGS. 4 and 5 illustrate a tire connector 50 in various stages of assembly. The tire connector 50 includes a pair of horizontal supports 54 that extend outward from the rear of the vertical support 30. The supports 54 may be connected directly to the vertical supports 30. In one embodiment, the supports 54 are connected to an inner cross-brace 51 that in turn is connected to the vertical supports 30. The inner cross-brace 51 may be sized such that the supports 54 are able to be positioned on opposing front and rear sides of the tire. The tire connector 50 also includes an outer cross-brace 52 also extends across and is connected to an end of the supports 54. The supports 54 and cross-braces 51, 52 are connected together to form an enclosed interior space sized to extend over a top of the tire 110. An intermediate cross-brace 53 extends across the supports 54 and may be adjustable between the cross-braces 51, 52 to accommodate the truck tire 110. The driver is able to position the cross-brace 53 at the desired location to form a gap with the cross-brace 52 to fit the size of the particular tire 110. Once assembled, the tire connector 50 forms a rigid structure to attach the device 10 to the tire 110 and to position and support the frame 65 outward away from the trailer 100.

The structure of the elements of the tire connector 50 provide for adjustability to accommodate different vehicles 100. As illustrated in FIGS. 4 and 5, the various elements 51, 52, 53, 54 may be attached above or below one another. For example, horizontal supports may be attached to a top of the inner cross-brace 51 (as illustrated in FIGS. 4 and 5), or may be attached to a bottom. Likewise, outer cross-brace 52 may be attached to the bottom of horizontal supports 54 (as illustrated) or to the top.

The device 10 is constructed from rigid material that can hold the weight of the user and the various forces that are applied during the exercises. The various elements may be constructed from various metals, such as steel and aluminum. One or more of the elements may include elongated, hollow shapes that provide for the needed strength without an excessive amount of weight. One or more of the elements may also include at least one flat side that provides for abutting together with an adjacent element and being connected together. The flat sides provide for larger contact area between the elements and a tighter fit when connected together by fasteners. Further, the flat sides may prevent and/or reduce relative rotating between the elements when connected together. In one specific embodiment, one or more the elements include a rectangular cross-sectional shape with a hollow interior.

The various elements may be connected together in various manners during the assembly process. As illustrated in FIGS. 2, 4, and 5, one or more of the elements include a series of apertures 70 arranged along their length. The elements can be aligned relative to each other at the appropriate position and apertures aligned together. A fastener 71 can be inserted through the aligned apertures 70 to connect the elements together. A variety of different fasteners 71 may be used to connect the elements together, including but not limited to bolts, pins, rod, and rivets. The fasteners 71 may also be equipped with a securing fixture, such as a bolt or pin that prevents inadvertent removal from the elements. The fasteners 71 also provide for straight-forward assembly and disassembly by the driver when using the device 10 on the road.

Figure 6:
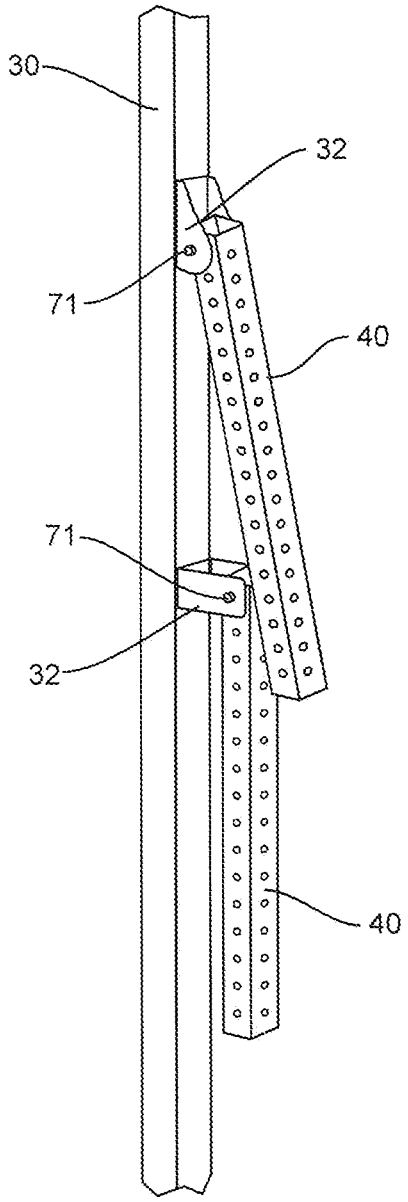
FIG. 6 is a side view of horizontal supports in a folded orientation against a vertical support.

The horizontal supports 40 may also be pivotally attached to the vertical support 30. This includes each of the supports 40 being connected to the vertical support 30 and pivotal between a closed orientation in which the horizontal support 40 is pivoted inward in proximity to the vertical support 30, and an open orientation in which the horizontal support 40 is pivoted outward away from the vertical support 30. FIG. 6 illustrates the horizontal supports 40 in a closed orientation pivoted in close proximity to the vertical support 30.

Figure 7:
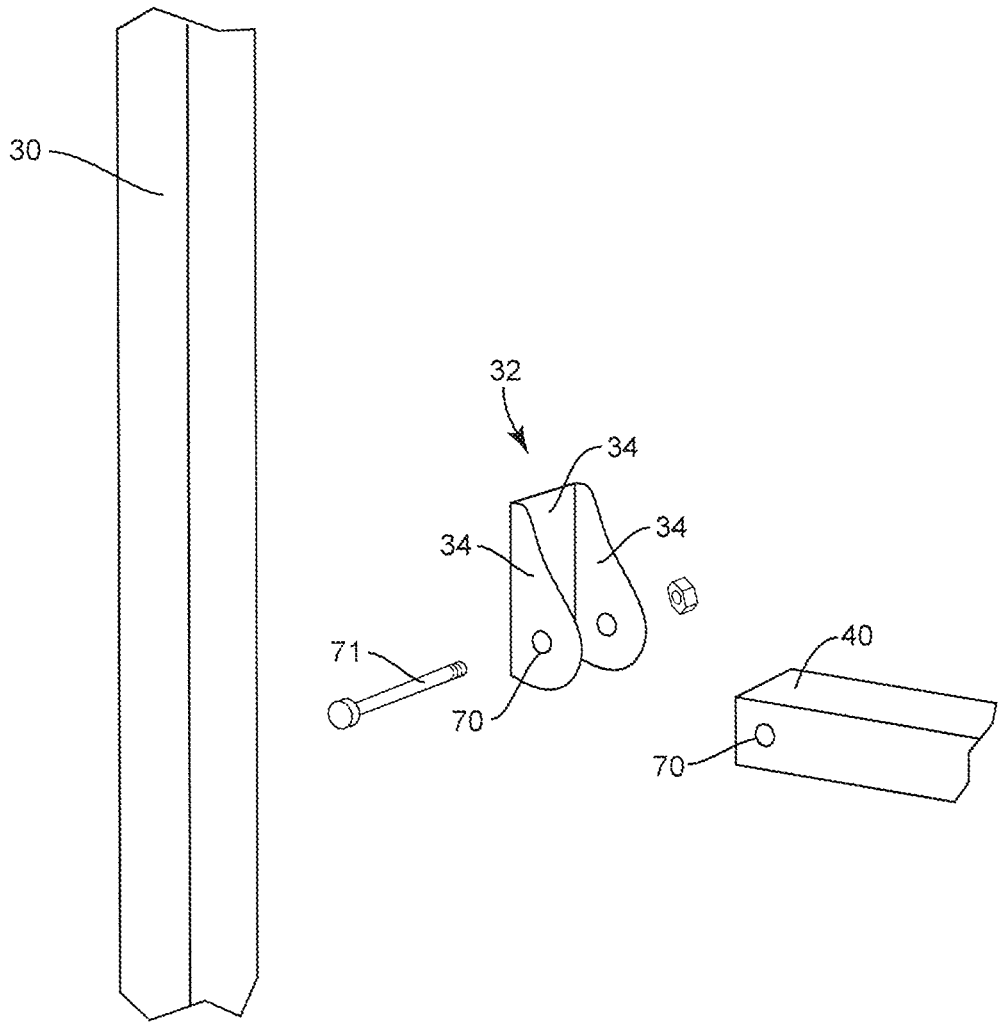
FIG. 7 is an exploded perspective view of a mount and fastener configured to connect with a horizontal support.
Figure 8:
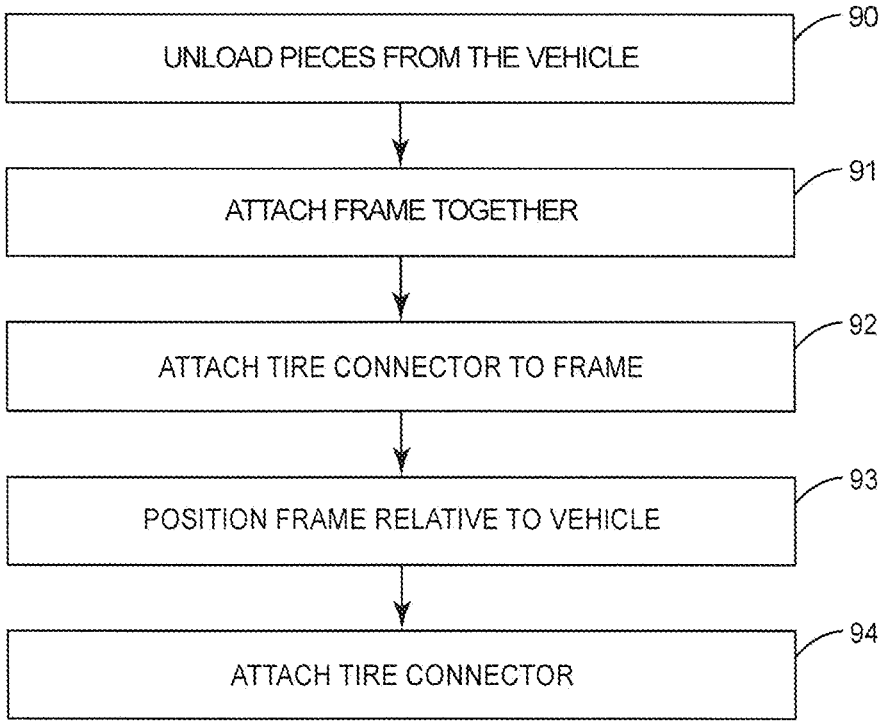
FIG. 8 is a flow diagram of a method of assembling an exercise device and attaching the device to a vehicle.

FIG. 7 illustrates an exploded view of the connection between the vertical support 30 and the horizontal support 40. The connection includes a mount 32 that is attached to the vertical support 30. The mount 32 includes a C-shape with a flat back side that abuts against and is connected to the vertical support 30. The connection may be through a mechanical fastener or various other connection procedures such as but not limited to welding. The mount 32 also includes a pair of lateral sides 34 that are spaced apart a distance such that the horizontal extension 40 can fit therebetween. Each of the lateral sides 34 and the horizontal extension 40 include apertures 70 that align together to receive a fastener 71. When the device 10 is not in use, the horizontal extension 40 can be pivoted downward against the vertical support 30 to reduce the overall size and therefore facilitate storage on the truck.

FIG. 6 illustrates an embodiment of the device 10 with each of the horizontal extensions 40 including the upper horizontal extensions 41, intermediate extensions 42, and horizontal bench extension 46 pivoted against the vertical support 30. This connection also provides for removal of the fastener 35 to remove the horizontal extension 40 either during storage or when not in use. In one embodiment, the one or more horizontal supports 46 for the bench 45 are either pivoted downward or removed when not in use to allow for the driver to exercise using the higher horizontal extensions 40 (e.g., the bench 45 is removed prior to performing pull-up exercises using the upper horizontal extensions 41).

The pivotally connected horizontal supports 40 are pivoted outward to the open orientation. Once positioned, the horizontal supports 40 are secured in the open position. This may include inserting a second fastener 71 into the mount 32 to maintain the position and/or further tightening the fastener 71 that attaches the horizontal support 40 to the vertical support 30. This may also include attaching an angled brace 44 under the horizontal support 40.

The device 10 may include one or more of the horizontal supports 40 being pivotally connected to the vertical support 30. In one embodiment, each of the horizontal supports 40 are pivotally connected to the vertical supports 30.

Figure 9:
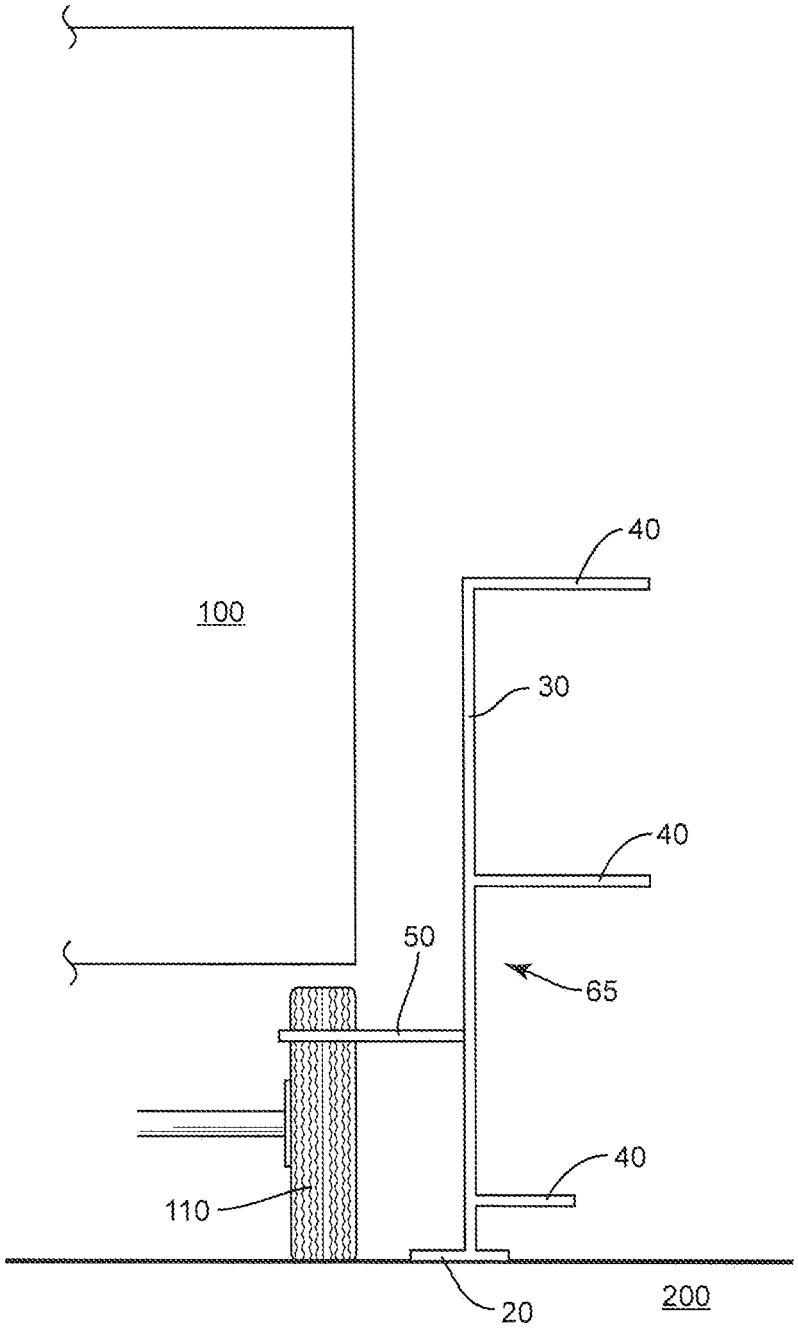
FIG. 9 is a schematic side view of an exercise device connected to a tire of a vehicle.

The device 10 is configured to facilitate assembly and use by the driver while out on the road. FIG. 9 illustrates one method of using the device 10 once the vehicle is positioned at a location to allow use of the device 10. Initially, the various pieces of the device 10 are unloaded from the vehicle (block 90). The various pieces may be stored inside the cab, inside the trailer, or attached to the outside of the vehicle. The process may include the driver removing all the pieces from the vehicle prior to assembly, or removing the various pieces as they are assembled together.

The assembly process may initially include assembling the frame 65 (block 91). This may include attaching two or more separate pieces together that make up the frame. For example, this may include connecting the base 20 with the vertical support 30. This assembly may include aligning a receptacle on a bottom of the vertical support 30 with an extension on the base 20. FIGS. 1A and 1B illustrate this type of embodiment with the bottom of the vertical supports 30 positioned around and overlapping with the extensions on the base 20. This overlapping arrangement may maintain the pieces attached together when the device 10 is in use during exercising. In one embodiment, the base 20 and the vertical support 30 are previously attached, such as the two parts are integral.

Assembling the frame 65 may also include attaching one or more horizontal extensions 40 to the vertical support 30. This may include aligning the horizontal supports 40 at the appropriate position along the vertical support 30. Apertures on each of the elements are aligned and one or more fasteners 71 are inserted to secure the pieces together. The device 10 may include multiple horizontal extensions 40 that are attached to the vertical support 30. The assembly process may include attaching a first horizontal extension 40 at the top end of the vertical support 30, and a second horizontal extension 40 is attached at an intermediate position between the first extension 40 and the base 20.

The one or more horizontal extensions 40 may already be attached to the vertical support 30, such as for the pivoting embodiment as illustrated in FIGS. 6 and 7. Assembly of this device 10 includes the user pivoting the horizontal extension 40 about the connection point by moving the second end of the extension away from the vertical support. Once pivoted outward, the extension 40 is fixed in the extended orientation. This may include insertion of a fastener within aligned apertures and/or positioning a brace 44 between the underside of the horizontal extension and the vertical support 30.

The assembly process may also include attachment of the tire connector 50 to the vertical support. This may include attaching first and second horizontal supports 54 to the vertical support 30. The horizontal supports are spaced apart a distance to receive the tire 110. The outer cross-brace 52 and/or inner cross-brace 53 may be positioned across and attached to the horizontal supports 54. In one embodiment, both cross-braces 52, 53 are connected to the horizontal supports 54 at this time. Other embodiment may include connecting of one or both cross-braces at a later time.

The various pieces of the frame 65 may be attached together in different times. The base 20 may be initially attached to the vertical support 30, followed by the one or more horizontal extensions 40 and the tire connector 50. The one or more horizontal supports 40 may be initially attached to the vertical support 30, followed by attachment of the base 20.

The assembly process also includes attaching the tire connector 50 to the frame (block 92). The tire connector 50 may be attached at various times during the assembly process. This may include after the frame 65 is assembled, or may include after two or more pieces of the frame 65 are assembled. Alternatively, the tire connector 50 may be initially attached to the vertical support 30 prior to attaching together any other pieces of the frame 65.

Once the frame 65 and tire connector 50 are assembled, it is aligned with the tire 110 (block 93). This includes positioning the base 20 on the ground in front of the tire 100 with one or more legs 24 and supports 23 in contact with the ground. The vertical support 30 is further aligned with the tire and positioned outward from the tire 110 and the trailer 100 to prevent any potential damage that may occur if there was to be contact. The height of the vertical support 30 provides for it to extend above the tire 110 when the frame 65 is placed in proximity to the truck.

The tire connector 50 is then attached to the tire (block 94). This may include positioning the two horizontal supports 54 in the front of and behind the tire 110. A first support 54 may be positioned in contact with the treads on the front side of the tire 110, and a second support 54 is positioned against the treads on the back side of the tire 110. The outer cross-brace 52 is further positioned behind the tire 110. In one embodiment, the interior cross-brace 53 is attached to the horizontal supports 54 prior to being positioned over the tire 110. In another embodiment, the interior cross-brace 53 is attached to the supports 54 after the supports 54 positioned on the tire 110. This may include the driver reaching into the wheel well to position the interior cross-brace 53 into contact with the tire 110. The gap between the outer cross-brace 52 and the interior brace 53 is sized to receive the tire 110. The gap between the braces 52, 53 is roughly the width of the tire 110 such that each cross-brace 52, 53 contacts against an opposing side of the tire 110. Further, the horizontal supports 54 are spaced apart to further envelope the tire 110. Thus, an enclosed frame extends around and contacts the tire 110. This contact supports the frame 65 and prevents and/or reduces any movement of the frame 65 during exercise by the driver.

FIG. 9 schematically illustrates the device 10 connected to the truck and positioned relative to the trailer 100 and tire 110. The frame 65 is aligned with the tire 110 with the tire connector 50 extending around the tire 110 and the base 20 positioned on the ground 200. The length of the tire connector 50 positions the vertical support 30 outward away from the tire 110 and the side of the trailer 100. During exercise, this spacing prevents the frame 65 from contacting against the truck which could potentially damage the truck.

Once the driver has finished exercising, the device 10 may be removed from the truck. This may include lifting the tire connector 50 off the tire 110, or otherwise disassembling the tire connector 50. The driver is further able to disassemble the frame 65 into the various separate pieces. These separate pieces may then be stored on the truck for use during the next exercising session.

Figure 10:
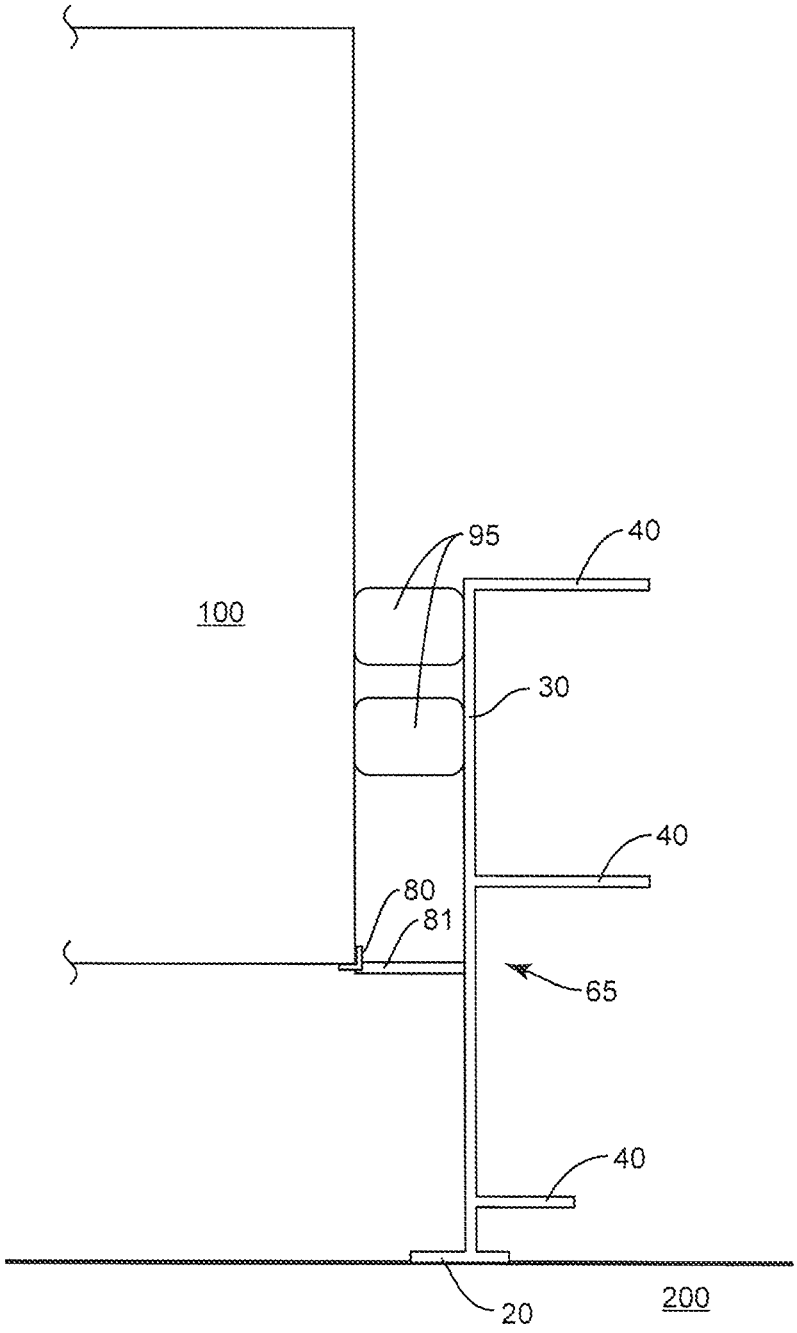
FIG. 10 is a schematic side view of an exercise device connected with one or more clamps to a trailer.

The device 10 may include a tire connector 50 to attach to the vehicle 100 as described above. Another manner of attaching the device 10 to the vehicle 100 includes the use of one or more clamps 80 as illustrated in FIG. 10. The clamps 80 may include a pair of opposing jaws that are movable between an open orientation and a closed orientation. The jaws in the open orientation are sized to extend around an edge of underside portion of the trailer 100 and to be moved to the closed orientation to attach to the trailer 100. This secures the device 10 to allow for the user to perform the variety of exercises. The use of one or more clamps allows the driver to position the device 10 at a variety of locations about the trailer 100, and is not limited to positioning just at one of the tires 110.

The one or more clamps 80 may be used with an extension 81 as illustrated in FIG. 10. The extension 81 maintains the frame 65 away from the side of the trailer 100 where it could possibly scratch, dent, or otherwise damage the trailer 100 during the exercises. Padding 95 may also be attached to a back side of the vertical support 30. The padding 95 is configured to further protect the trailer 110 from possible damage during use. The padding 95 may be permanently attached to the vertical support 30, or may be a separate member that is inserted between the vertical support 30 and the trailer 30 once the device 10 is attached to the vehicle. Various types of padding 95 may be used, including but not limited to foam material and cloth.

The description above describes the use of the device 10 by a truck driver. The device 10 is also applicable for use by others, such as drivers as various other types of vehicles, or others that work with large, wheeled vehicles in which the device can be connected to the tire.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of using an exercise device with a vehicle, the vehicle including a tire and a sidewall positioned vertically above the tire, the method comprising:

attaching a vertical support to a base with the vertical support extending vertically outward from the base;

attaching a horizontal support to the vertical support with the horizontal support extending outward from a front of the vertical support;

attaching a tire connector to the vertical support, the tire connector extending outward from a rear of the vertical support and including a pair of spaced-apart supports that extend outward from the rear of the vertical support and first and second cross-braces that extend across a gap between the spaced-apart supports, the first and second cross-braces being spaced horizontally away from the vertical support;

positioning the base on a support surface and the tire connector on the tire of the vehicle with the spaced-apart supports positioned on tire treads on opposing front and rear sides of the tire, the first cross-brace positioned along an inner side of the tire away from the vertical support, and the second cross-brace positioned along an outer side of the tire towards the vertical support;

positioning the vertical support horizontally away from the tire and the sidewall of the vehicle with the base contacting against the support surface and the tire connector contacting against the tire and the horizontal support positioned vertically above the tire; and maintaining the vertical support spaced horizontally away from the tire and the sidewall of the vehicle while exercising with the horizontal support.

2. The method of claim 1, further comprising attaching the horizontal support to the vertical support prior to attaching the base to the vertical support.

3. The method of claim 1, further comprising positioning the tire connector along the vertical support between the horizontal support and the base.

4. The method of claim 1, wherein the vertical support comprises first and second elongated members that are spaced apart from one another, and attaching the vertical support to the base comprises attaching the first elongated member to a first receptacle in the base and attaching the second elongated member to a second receptacle in the base.

5. The method of claim 1, further comprising positioning the base relative to the vertical support with the base extending outward from the front and the rear of the vertical support.

6. The method of claim 1, further comprising positioning the horizontal support a greater distance outward from the vertical support than the base.

7. The method of claim 1, further comprising inserting an extension on the brace within a receptacle in the vertical support with the extension and the receptacle in an overlapping orientation.

8. A method of using an exercise device with a vehicle, the vehicle including a tire and a sidewall positioned vertically above the tire, the method comprising:

assembling together a frame that includes a base with legs that contact against a support surface, a vertical support, a tire connector that extends from a rear of the vertical support, and at least two horizontal supports that each extend outward from a front of the vertical support and are spaced away from the base, each of the base, the vertical support and the horizontal supports being separate prior to the assembly;

positioning the frame at the vehicle with the vertical support extending in front of the sidewall of the vehicle; attaching the frame to the vehicle;

positioning the vertical support horizontally away from the sidewall of the vehicle with the base contacting against the support surface ground while exercising with each of the horizontal supports; and contacting the base against the support surface and the tire connector against the tire and preventing the vertical support from pivoting away from the sidewall of the vehicle while exercising.

9. The method of claim 8, wherein attaching the frame to the vehicle includes attaching one or more clamps to the vehicle.

10. The method of claim 8, wherein attaching the frame to the vehicle includes attaching the tire connector to the tire by positioning the tire connector against front and rear treads of the tire and contacting a rear brace of the tire connector in contact with a back side of the tire that is away from the vertical support.

11. The method of claim 10, further comprising contacting a front brace of the tire connector in contact with a front side of the tire that is facing towards the vertical support, the front brace being spaced away from the rear brace by a gap that is sized to position the tire.

12. The method of claim 11, wherein each of the front and rear braces are straight.

13. The method of claim 10, further comprising positioning the tire connector against the tire and contacting the tire at three separation locations.

14. The method of claim 8, further comprising positioning each of the horizontal supports to extend perpendicularly outward from the sidewall of the vehicle.

15. The method of claim 8, wherein a first one of the horizontal supports extends outward from a vertical top of the vertical support.

16. A method of using an exercise device with a vehicle, the vehicle including a tire and a sidewall positioned vertically above the tire, the method comprising:

assembling together a frame that includes a base with legs that contact against a support surface, a vertical support, and a horizontal support;

moving the horizontal support from a closed orientation to an open orientation by pivoting the horizontal support about an axis that extends through the vertical support and moving an outer end of the horizontal support to an extended position away from the horizontal support;

positioning the frame at the vehicle with the base at the tire of the vehicle, the vertical support extending in front of the tire and the sidewall of the vehicle, and the horizontal support positioned above the tire;

attaching a tire connector that extends from a rear of the vertical support to the tire of the vehicle;

positioning the vertical support horizontally away from the tire and the sidewall of the vehicle with the base contacting against the support surface and the tire connector contacting against the tire; and maintaining the vertical support spaced horizontally away from the tire and the sidewall of the vehicle while exercising with each of the horizontal supports.

17. The method of claim 16, further comprising positioning the tire in a gap formed by the tire connector with the tire connector extending completely around the tire.

18. The method of claim 16, further comprising attaching the tire connector to the tire prior to moving the horizontal support from the closed orientation to the open orientation.

* * * * *